United States Patent [19]

Sansing

[11] Patent Number: 4,948,197

[45] Date of Patent: Aug. 14, 1990

[54] CHILD SHAMPOOING CHAIR

[76] Inventor: Dayna L. Sansing, 29500 Heathercliff #79, Malibu, Calif. 90265

[21] Appl. No.: 409,762

[22] Filed: Sep. 20, 1989

Related U.S. Application Data

[63] Continuation-in-part of Ser. No. 329,199, Mar. 27, 1989, abandoned.

[51] Int. Cl.[5] ..... A47C 1/06; A47C 3/34

[52] U.S. Cl. ..... 297/194; 297/345; 297/391; 297/359

[58] Field of Search ..... 297/194, 391, 396, 359, 297/345, 416, 422, 227, 325, 27, 28

[56] References Cited

U.S. PATENT DOCUMENTS

| | | | |
|---|---|---|---|
| 1,970,480 | 8/1934 | Wood | 297/359 |
| 2,061,302 | 11/1936 | Egler | 297/194 |
| 2,463,049 | 3/1949 | Onsa | 297/396 |
| 2,797,738 | 7/1957 | Patterson | 297/345 |
| 3,103,386 | 9/1963 | Kerr | 297/416 |
| 3,233,940 | 2/1966 | Tooley, Jr. | 297/416 |
| 3,634,925 | 1/1972 | Van Loo | 297/227 |
| 4,514,009 | 4/1985 | Vanderminden et al. | 297/359 |
| 4,545,619 | 10/1985 | Garay | 297/416 |
| 4,728,147 | 3/1988 | Dutton | 297/194 |
| 4,772,068 | 9/1988 | Gleckler et al. | 297/325 |

*Primary Examiner*—Peter R. Brown

*Attorney, Agent, or Firm*—Jack C. Munro

[57] ABSTRACT

A child shampooing chair which is designed to be located within a bathing area such as a conventional bathtub. The child shampooing chair includes a conventional seat and a conventional back section with the back section being tiltable relative to the seat section to assume various inclined positions relative thereto. The legs of the child shampooing chair are to be adjustable in height. There are armrests mounted on the side edges of the seat section which include recesses within which is to be located a container such as a bottle of shampoo.

1 Claim, 1 Drawing Sheet

CHILD SHAMPOOING CHAIR

REFERENCE TO PRIOR APPLICATION

This application is a Continuation-in-Part of U.S. patent application Ser. No. 07/329,199, filed Mar. 27, 1989, by the same title.

BACKGROUND OF THE INVENTION

The field of this invention relates to a human being's seating device and more particularly to a chair that is designed primarily to be used when shampooing a child's hair.

When shampooing the hair of a human, it is well-known that the most comfortable position is to locate the human in a seating position and have the individual lean his/her head back with water and shampoo to be applied to the individual's head. Although this is the normal position in hair salons for the shampooing of one's hair, within homes, this is normally not the position that is utilized. When shampooing a child's hair by a parent, it is normal for the child to assume a forward, leaning over position with the head either being located within a sink of in a bathtub. This position is not comfortable to the individual receiving the shampoo. Also, it is not the position at which the hair can be shampooed most efficiently.

SUMMARY OF THE INVENTION

The structure of the present invention is to design a portable chair that can be readily used within one's home to efficiently clean the hair of a child with the child being located in a comfortable position.

Another advantage of the present, invention is to construct an apparatus which can be manufactured at a relatively inexpensive price and therefore sold to the ultimate consumer at an inexpensive price.

Another objective of the present invention is to construct a chair which is light in weight and which can be readily stowed when not in use and can be quickly and easily put into use.

The child shampooing chair of the present invention is constructed of a substantially planar seat section and a substantially planar back section. The back section is connected to one end of the seat section with the back section being movable to various inclined positions relative to the seat section. The upper end of the back section includes a padded recess area which is to be in contact by the neck of the child of whose hair is being shampooed. Connected between the back section and the seat section are a pair of armrest assemblies with one armrest assembly being located at one lateral edge of the seat section and the other armrest assembly being located at the opposite lateral edge of the seat section. The armrest assemblies are movable so as to permit inclination of the back section relative to the seat section. Once an established position of the back section relative to the seat section has been obtained, the movable parts of the armrest assemblies are locked in position preventing further movement. Each armrest assembly includes a planar armrest member upon which is to be located the forearm of the child. Each armrest member is to have attached thereto one or more container supporting recesses. Each armrest member is to be removably connected in conjunction with the armrest assembly. Mounted in conjunction with the seat section are a pair of U-shaped leg members with these leg members being adjustable to vary the distance of the seat section from the supportive surface upon which it is located. This adjustment of the leg members, once established, is fixed in position.

DETAILED DESCRIPTION OF THE SHOWN EMBODIMENT

Figure 1:
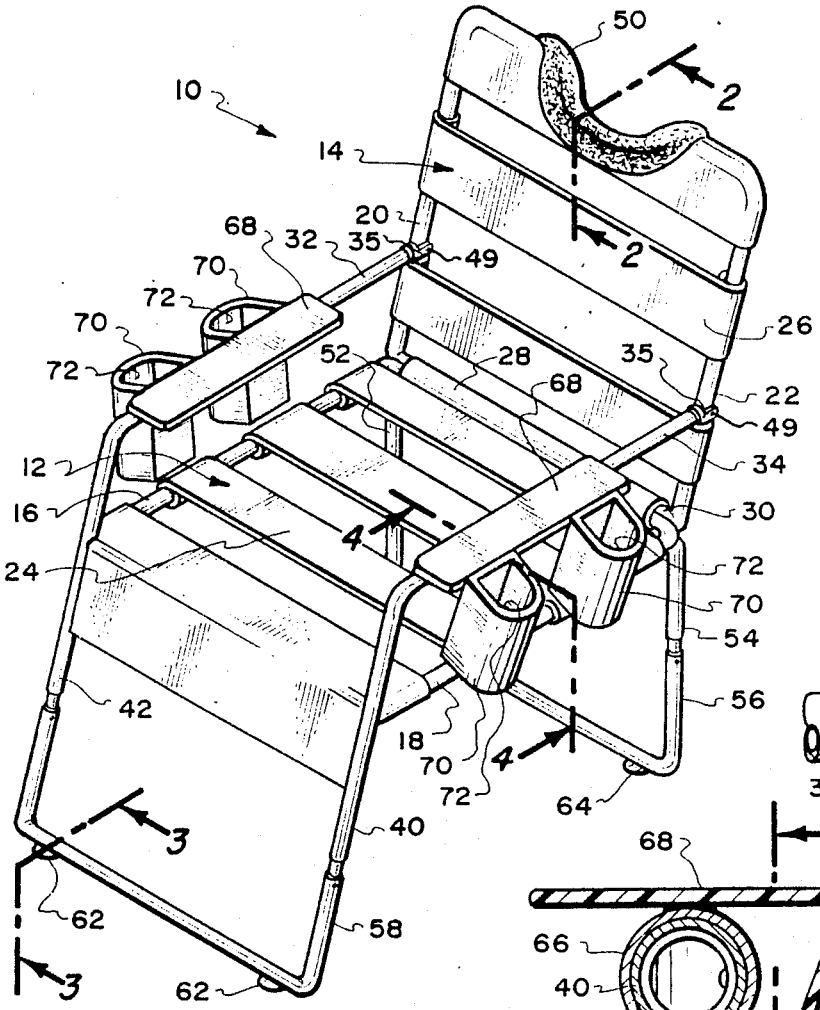
FIG. 1 is an isometric view of the child shampooing chair of the present invention.
Figure 2:
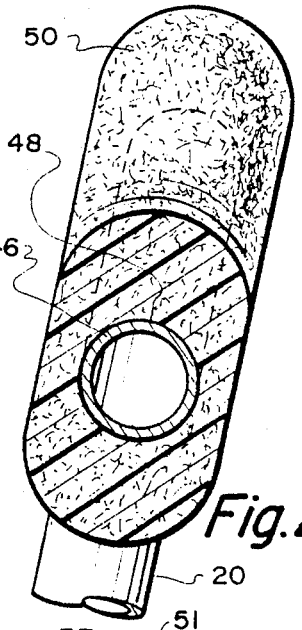
FIG. 2 is a cross-sectional view through the padded recess of the back section taken along line 2—2 of FIG. 1.
Figure 6:
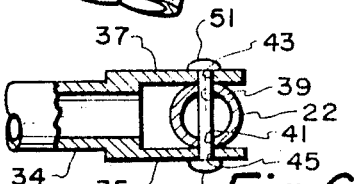
FIG. 6 is a cross-sectional view taken through a connection of an armrest assembly to the back section of the chair.

Referring particularly to FIG. 1, there is shown the child shampooing chair 10 of this invention which has a seat section 12 and a back section 14 The seat section 12 and the back section 14 can be constructed in any desirable manner. However, it is desired that there be openings provided within both the seat section 12 and the back section 14 for water to readily pass therethrough. One way in which the seat section 12 and the back section 14 can be so constructed to achieve this end is to compose the sections 12 and 14 of tubing located at their lateral edges, such as tubes 16 and 18 for the seat section 12 and tubes 20 and 22 for the back section 14. Typical tubing would be approximately one-half inch in diameter and can be either constructed of metal, such as aluminum, or could be constructed of plastic. Connected between the tubing 16 and 18 are a plurality of spaced apart web strips 24 with similar web strips 26 connecting between the tubing 20 and 22. A typical material of construction of the web strips 24 and 26 would be a plastic and would normally be about two inches in width. The webbing strips 24 and 26 are located in a spaced apart manner so as to form open spaces therebetween which will permit water to readily pass therethrough.

The tubes 16 and 18 are connected together at the back edge by a connecting tube 28. Surrounding this connecting tube 28 is a larger diametered tube 30. This larger diametered tube 30 is slightly shorter in length than tube 28. The tube 30 is supported on the tube 28 but is capable of pivoting movement thereon The tube 30 is fixed between tubes 20 and 22. Therefore, the back section 14 is capable of assuming various inclined positions relative to the seat section 12 due to the pivot connection between the tubes 28 and 30.

Arm tube 32 is pivotly connected by a pivot connecting arrangement to tube 20. In a similar manner the arm tube 34 is pivotly connected by an identical pivot connecting arrangement to tube 22. For purpose of description, the pivot connecting arrangement between arm tube 34 and tube 22 will only be discussed. However, it is considered that the description, including assigned numbers, will also apply to like parts in the pivot connecting arrangement between arm tube 32 and tube 20.

The outer end of arm tube 34 is bifurcated forming a pair of spaced apart, parallel legs 35 and 37. Tube 22 is located between legs 35 and 37. The width of the spacing between legs 35 and 37 is just slightly greater than the diameter of tube 22. Tube 22 has a pair of aligned holes 39 and 41 formed through the wall of tube 22. Leg 35 has a hole 45. Leg 37 has a hole 43. A pin 47 is to extend through holes 39, 47, 41 and 45. The outer ends of pin 47 are enlarged forming heads 49 and 51. As a result, when back section 14 is moved to various inclined positions, the arm tubes 32 and 34 are capable of pivoting slightly relative to their respective tubes 20 and 22. Arm tube 32 will always be parallel to the tube 16 with the arm tube 34 also always being parallel to the tube 18. The outer end of the tube 34 has integrally attached thereto a smaller diametered extension 36. It is to be understood that there will be a similar such extension attached to the outer end of the tube 32 which is not shown. Within the extension 36 is located a plurality of holes 38.

The extension 36 is telescopingly located within outer arm tube 40. It is to be understood that the extension mounted in conjunction with the arm 32 is also telescopingly located within an outer arm tube 42. Mounted on the tube 40 is a button 44 with this button 44 being movable in an inward direction to engage with any one of the holes 38. The button 44 is to be spring biased by a spring mechanism (not shown). It can thusly be seen that depending upon which hole 38 that the button 44 engages with, the back section 14 can be at various inclined positions relative to the seat section 12. In other words, the back section 14 can be located at a more upright manner or could be located at a more prone position type manner if such is deemed to be desired.

At the upper edge of the back section 14 and connected between the tubes 20 and 22 is a tube 46. This tube 46 is not straight, but includes a recess 48. Surrounding the tube 46 in the area of the recess 48 is a cushiony pad 50. The neck of the occupant of the chair 10 of this invention is to rest against the cushiony pad 50. A typical material for the cushiony pad 50 would be a foam or plastic rubber type of material.

Fixedly secured to the tube 16 and extending downwardly therefrom is a leg tube 52. A similar leg tube 54 is fixedly secured to the tube 18. Tubes 52 and 54 are located parallel to each other. Connecting between the tubes 52 and 54 is a U-shaped leg tubular member 56. A similar U-shaped leg member 58 connects with tubes 40 and 42. The U-shaped leg member 56 is telescopingly connected with the tubes 52 and 54. In a similar manner the U-shaped leg member 58 is telescopingly connected with the tubes 40 and 42.

The U-shaped leg members 56 and 58 are adjustable to vary the spacing of such from the seat section 12 so that the height of the seat section 12 can be changed relative to the supportive surface 60. This adjustment of different height is for the reason of individual desires. Once a desired height has been obtained, there has been incorporated a spring biased button and aperture arrangement between the leg member 56 and the tubes 52 and 54 and the leg member 58 and the tubes 40 and 42. This spring biased button and aperture arrangement is similar to the arrangement 38 and 44 as previously discussed.

To facilitate connection and fixing in position of the chair 10 on the supportive surface 60, there are mounted a pair of suction cups 62 on the leg member 58 which are to engage with the supportive surface 60. A similar pair of suction cups 64 are mounted on the leg member 56 which also engage with the supportive surface 60. The function of the suction cups 62 are to provide a small amount of gripping force between the chair 10 and the supportive surface 60.

Figure 4:
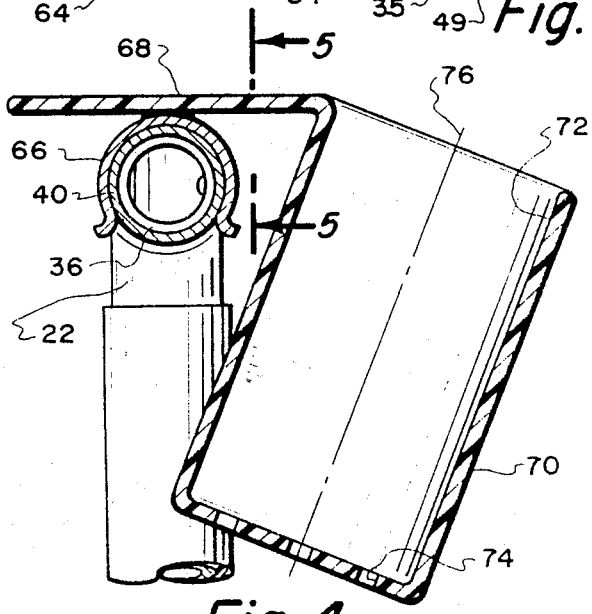
FIG. 4 is a cross-sectional view taken through one of the armrest assemblies of the chair of the present invention taken along line 4—4 of FIG. 1.
Figure 3:
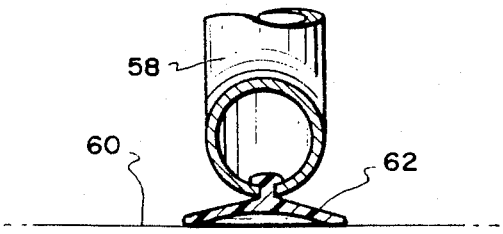
FIG. 3 is a cross-sectional view through one of the leg members of the chair of the present invention taken along line 3—3 of FIG. 1.
Figure 5:
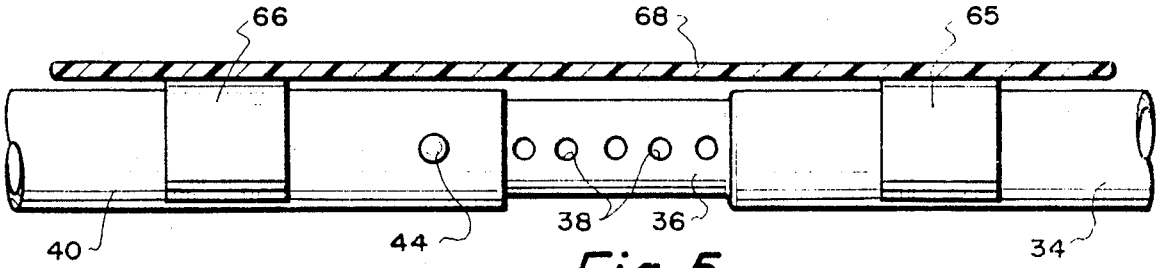
FIG. 5 is a side elevational view, partly in cross-section, of an armrest assembly taken along 5—5 of FIG. 4 showing in more detail the adjustable feature included within the armrest assembly.

Mounted on the tubes 34 and 40 and located therebetween are, respectively, a pair of spring clamp members 65 and 66. These clamp members 65 and 66 are fixedly connected to the undersurface of a planar armrest member 68. The armrest member 68 is to facilitate locating of a forearm of a human being thereon when the chair 10 is occupied. Integrally attached to the outer lateral edge of the armrest member 68 are a pair of container supports 70. Each of the container supports 70 includes a cylindrical shaped opening 72. The bottom surface of the container support 70 includes a plurality of holes 74 which are to permit water to pass therethrough if such is caused to accumulate within the cylindrically shaped chamber 72. It is to be noted that the longitudinal center axis 76 of the cylindrical recess 72 is inclined from the vertical axis which would be the axis located perpendicular to the supportive surface 60. The reason for this inclination is that upon a fluid container, such as a bottle of shampoo, being located within the recess 72 that it facilitates entry and withdrawal from the recess 72 because the recesses 72 are inclined as clearly shown within FIG. 4 of the drawing. It is to be understood that an armrest member 68 and a pair of container members 70 are also mounted between tubes 32 and 42.

What is claimed is:

1. A child shampooing chair comprising:

a substantially planar seat section adapted to connect with the buttocks of a child;

a substantially planar back section connected by a pivot joint to said seat section, said back section assuming a transverse location to said seat section, said back section adapted to connect with the back of a child, said back section being adjustably movable to various inclined positions relative to said seat section;

a leg assembly attached to said seat section, said leg assembly being adjustable in length to change the distance of said seat section from a supportive surface;

said back section having a free upper edge adapted to contact with the neck of a child, said free upper edge including a recess, said recess including a resilient pad;

a pair of spaced apart arm member assemblies connected between said back section and said seat section, each said arm member assembly comprising a pair of arm members movable relative to each other to permit adjusting movement of said back section relative to said seat section with pivoting occurring through said pivot joint, each said arm member assembly including locking means for fixing the established position of said back section relative to said seat section, a said arm member of each said arm member assembly being pivotally connected to said back section so as to permit limited pivoting movement therebetween as said back section is moved to the various inclined positions, each said arm member assembly including a planar armrest defining a horizontally disposed planar surface, said planar surfaces of said arm member assemblies being in alignment and in a single horizontal plane, each said planar armrest being movably mounted on its respective said pair of arm members; and at least one container support device being fixedly secured to each said armrest member assembly, each said container support device includes a plurality of recesses, a said recess is to facilitate connection with a separate container such as a bottle of shampoo, each said recess has a longitudinal center axis, each said longitudinal center axis being inclined relative to vertical establishing a non-perpendicular position relative to said single horizontal plane.

* * * * *